United States Patent [19]

Ott

[11] 4,134,236

[45] Jan. 16, 1979

[54] SIDE SHOE ASSEMBLY FOR A CRANE BOOM

[75] Inventor: Edward R. Ott, Plainfield, Ill.

[73] Assignee: Clark Equipment Company, Buchanan, Mich.

[21] Appl. No.: 744,908

[22] Filed: Nov. 26, 1976

[51] Int. Cl.[2] ..... E04H 12/34

[52] U.S. Cl. ..... 52/118; 52/632; 212/144

[58] Field of Search ..... 212/54–55, 212/46 B, 144, 57; 187/9 E; 52/111, 114–115, 117–118, 632

[56] References Cited

U.S. PATENT DOCUMENTS

| | | | |
|---|---|---|---|
| 3,221,482 | 12/1965 | Cowling | 212/55 X |
| 3,243,052 | 3/1966 | Grove | 212/55 |
| 3,259,251 | 7/1966 | Stauffer | 212/55 |
| 3,264,979 | 12/1971 | Przybylski | 212/55 |
| 3,620,579 | 11/1971 | Brown et al. | 212/55 X |
| 3,736,710 | 6/1973 | Sterner | 52/115 |
| 3,738,075 | 6/1973 | Nansel | 212/55 X |
| 4,004,695 | 1/1977 | Hackensmith et al. | 212/144 |

*Primary Examiner*—Lawrence J. Oresky
*Assistant Examiner*—R. B. Johnson
*Attorney, Agent, or Firm*—John C. Wiessler

[57] ABSTRACT

Adjustable side shoe assemblies are provided on respective side walls of adjacent movable boom sections of a crane boom assembly to maintain alignment between the sections. A boss provided on each side wall at the upper end of a movable boom section of a crane boom assembly has a tapped hole passing through the section. A threadable member, preferably composed of a phenolic or other abradable material can be inserted into the threaded opening provided in the side wall of the boom section, the member being threadably rotated into the opening to engage the side wall of the next adjacent boom section. Respective aligned openings provided in the side walls of the boss and the threadable member receive a retaining member, such as a cotter pin, to hold the threadable member in place on the boom section. The openings in the threadable member may be placed at spaced intervals to permit inward adjustment of the threadable member to compensate for the wear of such member under repeated extension and retraction of the boom assembly. A similar arrangement is provided at the opposite end of the next inner boom section, with the boss projecting inwardly and the threadable member being threaded outwardly to engage the next outer boom section to hold pairs of adjacent sections in aligned relationship at the lower ends of the sections.

3 Claims, 5 Drawing Figures

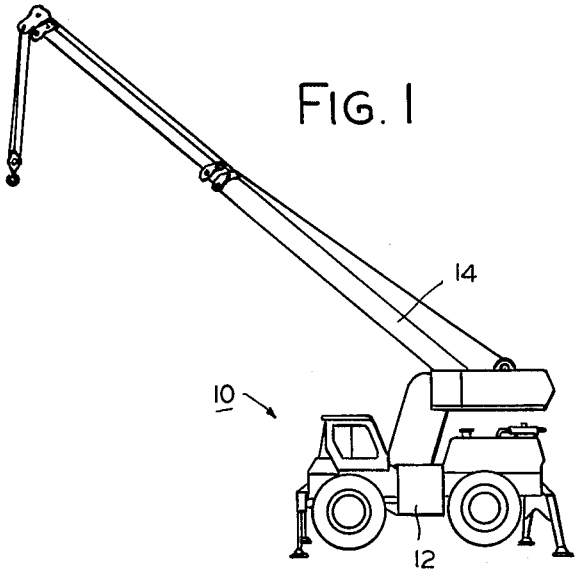
FIG. 1
FIG. 3
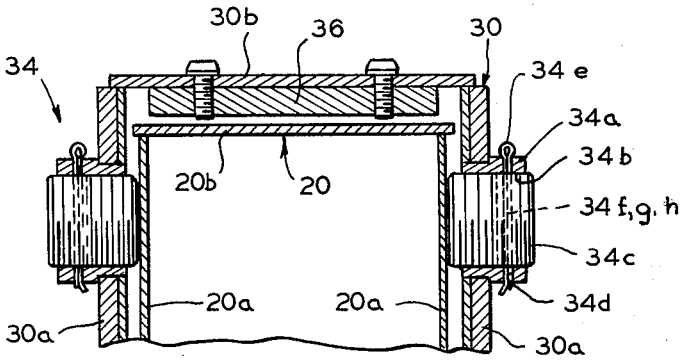
FIG. 4
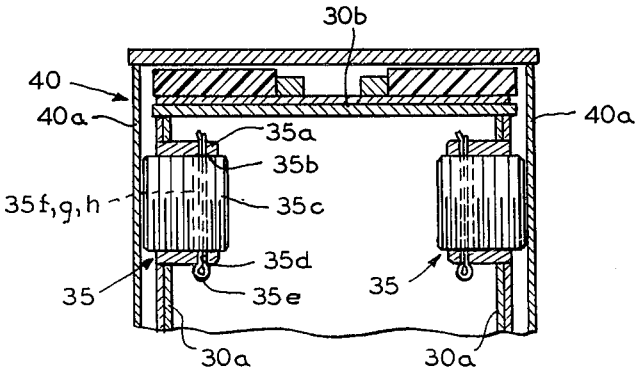

SIDE SHOE ASSEMBLY FOR A CRANE BOOM

BACKGROUND OF THE INVENTION

1. Field of the Invention

In a crane boom having a plurality of extendible and retractable telescoping sections, considerable abrasion can occur between adjacent sections during reciprocable operation of the boom. Typically, bearing surfaces are provided between adjacent boom sections to minimize the abrasion between such sections and to assure proper alignment of the extended boom assembly.

2. Prior Art

Since the top and bottom plates of adjacent boom sections are weight bearing surfaces as well as abrasive surfaces permanently installed bearing plates or shoes are provided at respective opposite ends of each boom section to minimize wear and abrasion between adjacent boom sections at these critical loading points. This type of permanent installation has heretofore been employed with respect to the side shoes provided on respective side walls of adjacent boom sections. These side wall installations are particularly troublesome to replace and in certain instances can require the dismantling and rebuilding of the entire boom assembly in order to effect replacement of such side shoe assemblies. Such a permanent type installation is not deemed necessary in view of the fact that the side shoes are merely provided to align adjacent boom sections and to minimize abrasion between adjacent boom sections and are not critical weight bearing assemblies.

Accordingly, it would be desirable if the side shoe assemblies of a telescoping crane boom assembly could be made readily replaceable with minimum disassembly of the boom assembly.

Additionally, it would be desirably if such replacement side shoe assemblies would include an abradable member which is readily adjustable to compensate for wear caused by cyclic operation of the boom assembly.

SUMMARY OF THE INVENTION

The present invention provides an adjustable side shoe assembly wherein an abradable member can be readily replaced without dismantling the boom assembly. Further, the side shoe assembly incorporates a threadable abradable member capable of threaded adjustment to compensate for wear caused by abrasion between the next adjacent boom section and the threadable member.

The present invention comprises an adjustable side shoe assembly including a plurality of raised bosses provided at a forward end of each boom section of a boom assembly having multiple extendible and retractable boom sections, the bosses provided on opposite side walls of each boom section of the boom assembly. Each of the bosses has a threaded opening extending into the interior of the section. Threadably mounted in the boss is an abradable member which can be adjusted to engage the next adjacent boom section of the boom assembly. The threaded member is also provided with a plurality of spaced passages transverse to the axis thereof, said passages capable of being aligned with a pair of axially aligned peripheral openings provided in the respective boss associated with the abradable member, to receive a locking member therethrough.

At the rear of each boom section a pair of aligned bosses are provided on opposite side walls of the boom section, such bosses having threaded openings therein.

Corresponding abradable members are received in the rear bosses to be rotated outwardly to engage the adjacent outer boom section to align respective adjacent boom sections of the boom assembly at the rear thereof. The side shoe assemblies provided at the rear of the boom sections correspond generally to those provided at the front of the boom section with like adjusting means provided therein.

A more detailed description of the present invention is provided below, and should be considered in conjunction with the accompanying drawings for a more complete understanding of the present invention.

BRIEF DESCRIPTION OF THE DRAWINGS

FIG. 1 is a side elevation of a truck mounted telescoping crane boom assembly which employs a preferred embodiment of the present invention;

FIG. 3 is a view taken along the lines 3—3 of FIG. 2A; and

FIG. 4 is a view taken along the lines 4—4 of FIG. 2B.

DETAILED DESCRIPTION

Figure 2A:
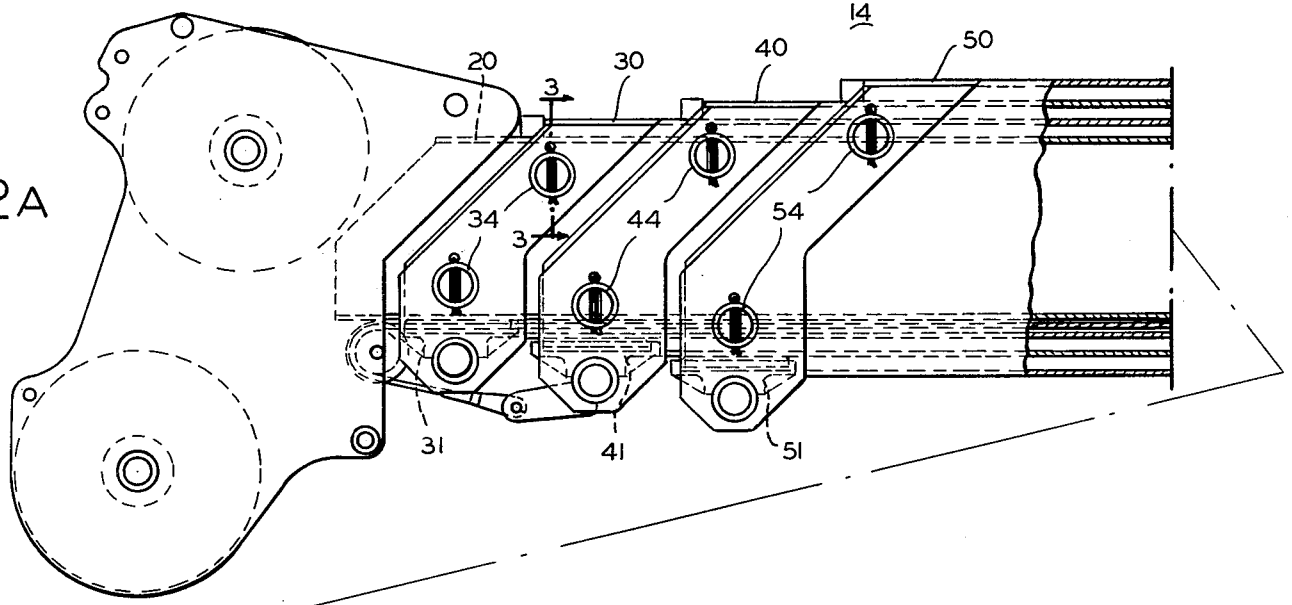
FIG. 2 is a partial sectional view of the adjustable side shoe assembly provided at the forward end of the boom and FIG. 2B is a sectional view which shows the adjustable side shoe assembly provided at the rear end of adjacent boom sections.
Figure 2B:
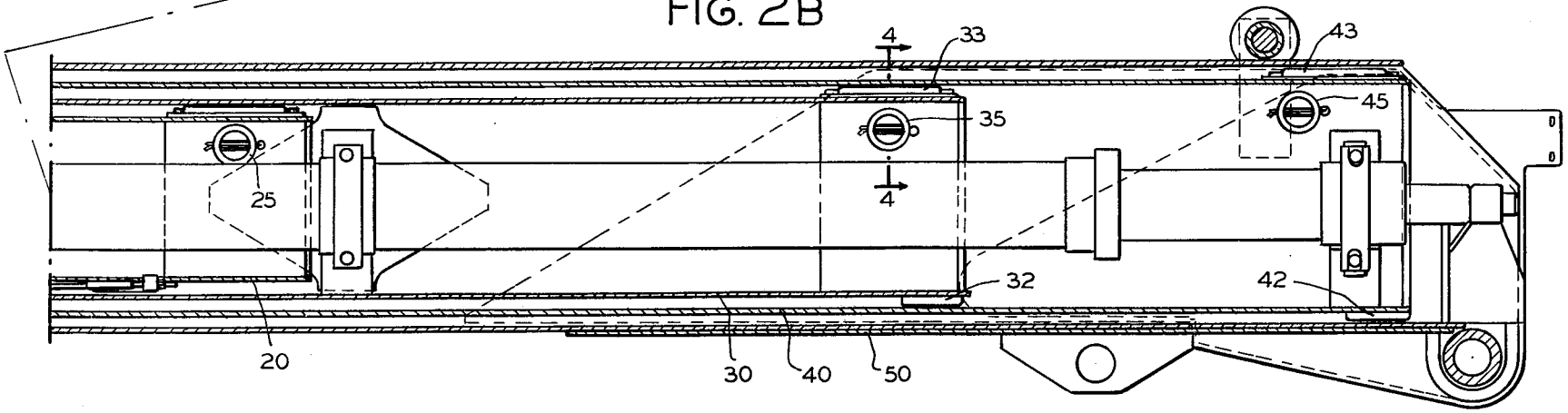

A truck mounted crane 10 comprises a base 12 and a telescoping boom assembly 14. The boom assembly 14 comprises a plurality of extendible and retractable sections 20, 30, 40 and 50 which telescope one into the other. Each of boom sections 30, 40 and 50 support and receive therein adjacent boom sections 20, 30 and 40 respectively. Bearing against and supporting the next inner adjacent boom section is a series of forward bottom shoes 31, 41 and 51. Respective bottom rear shoes 32 and 42 engage next respective outer sections 40 and 50 as shown in FIG. *2b*. Top rear shoes 33 and 43 are provided on respective boom sections 30 and 40 to engage next outer sections 40 and 50 respectively. The side shoe assemblies of the present invention comprise the assemblies 34, 44, and 54 provided on respective boom sections 30, 40 and 50 at the front end of the boom assembly 14 as shown in FIG. *2a* and rear side shoe assemblies 25, 35 and 45 provided on sections 20, 30 and 40 of the boom assembly 14.

The front side shoe assemblies 34, 44 and 54 differ only in mounting location and therefore it will be sufficient to describe only one of such assemblies in detail. It is also noted that the rear assemblies 25, 35 and 45 are similar except for location and that only one of these assemblies need be described in detail.

Referring now to FIG. 3, the side shoe assembly 34 comprises a boss **34*a* provided in side wall 30*a* of the boom section 30. A top wall 30*b* connects respective side walls 30*a* of boom section 30. The front top shoe 36 is provided on the top wall 30*b* of the boom section 30. The boss 34*a* has a bore 34*b* provided therein, said bore being threaded to receive an abradable member 34*c*, the member 34*c* being threaded to be received into the opening 34*b* in the boss 34*a*. The member 34*c* is threaded inwardly so that its inner end engages side wall 20*a* of next adacent inner boom section 20 of the boom assembly 14. Axially aligned openings 34*d* provided in the side walls of the boss 34*a* receive a pin 34*e* which also passes through one of a plurality of openings of 34*f*, 34*g* or 34*h* transversely spaced along the axis of the abradable member 34c. Insertion of the pin 34e into one of the openings 34f, 34g, 34h maintains the engagement of the member 34c against the side wall 20a of the next adacent inner boom section 20**.

Referring now to FIG. 4, the rear side shoe assembly comprises a boss 35a provided at an upper rear portion of the side wall 30a of the boom section 30. A threaded opening 35b is provided in the boss 35a suitable for receiving an abradable member 35c. Aligned openings 35d provided in the side walls of the boss 35a receive a pin 35e. The pin 35e passes through openings 34d in the side walls of the boss 34a as well as one of transversely spaced openings 35f, 35g or 35e passing through the abradable member 35c. The member 35c is threaded outwardly to engage respective side wall 40a of the outer adjacent section 40 of the boom assembly 14.

It can readily be observed from a consideration of the detailed description and the drawings provided therewith that the adjustable side shoe assemblies provide a simple means for maintaining adjustment between adjacent boom sections of an extendible and retractable telescoping boom assembly. The abradable members associated with the side shoe assemblies can be readily adjusted to maintain alignment between adjacent boom sections and when such members have been worn to the limits of their adjustments they can be readily removed, discarded and replaced without dismantling of the boom assembly, and with little interruption in the normal operating cycle of the crane.

Having thus described a preferred embodiment of the present invention, it should be readily apparent to the reader that obvious changes can be made in the form of the structure recited herein without affecting the substance of the invention as defined in the appended claims.

I claim:

1. In a crane boom assembly having a plurality of extensible and retractable boom sections telescopically nested one within the other, each boom section comprising a top wall, a bottom wall and connecting side walls therebetween, a plurality of adjustable side shoe assemblies provided between adjacent boom sections for maintaining alignment of the boom assembly as it is extended and retracted, certain of said side shoe assemblies being mounted on the side walls of an intermediate boom section at the forward end thereof and adjustable inwardly to engage the respective side walls of the next adjacent inner boom section, and certain of said side shoe assemblies being also mounted on the side walls of said intermediate boom section at the rear end thereof and adjustable outwardly to engage the respective side walls of the next adjacent outer boom section, each of said forward side shoe assemblies comprising an outwardly extending boss secured on an intermediate boom side wall having a threaded opening therein, and a threaded adjustment member received in said opening and adjustable to maintain engagement with the side wall of the next adjacent inner boom section, each of said rear side shoe assemblies comprising an inwardly projecting boss on an intermediate boom side wall having a threaded opening therein and a threaded adjustment member received in said opening and adjustable to maintain engagement with the side wall of the next adjacent outer boom section, said side shoe assemblies being periodically adjustable against the respective inner and outer adjacent boom sections to maintain alignment without disassembly of the boom assembly.

2. A crane boom assembly as claimed in claim 1 wherein radially extending and axially aligned openings are provided in the side walls of the boss, the adjustable member having a plurality of transversely spaced bores therein, and a pin receivable through the openings in the walls of the boss and a selected one of the transverse bores in the adjustable member to maintain the member in fixed relation with respect to the adjacent boom section cooperatively engaged therewith.

3. In a crane boom assembly having a plurality of extensible and retractable boom sections telescopically nested one within the other, each boom section comprising a top wall, a bottom wall and connecting side walls therebetween, a plurality of front and rear adjustable side shoe assemblies provided between adjacent boom sections for aligning the boom assembly as it is extended and retracted, each front side shoe assembly being mounted on a side wall of one boom section at the forward end thereof and having a boss projecting outwardly of the side wall, a threaded opening extending through the boss and a threaded guide member adjustable inwardly of the boss to engage a respective side wall of the next adjacent inner boom section, each of said rear side shoe assemblies being mounted on a side wall of said one boom section at the rear end thereof and having a boss projecting inwardly of the side wall, a threaded opening extending through the boss and a threaded guide member adjustable outwardly of the boss to engage a respective side wall of the next adjacent outer boom section, said bosses having radially extending and axially aligned openings provided in the side walls thereof and said guide members having transverse bores therein, and a locking pin receivable through side wall openings in each boss and engageable in a bore provided in each guide member such that when the guide member is adjusted inwardly of its boss a selected bore and side wall openings are aligned so that the locking pin may be inserted to maintain the guide member in fixed relation with respect to the adjacent boom section and in cooperative engagement therewith, whereby the guide members of the front and rear side shoe assemblies are adjustable to maintain alignment between respective inner, intermediate and outer boom sections during operation of the boom assembly.

* * * * *